US007059283B2

(12) United States Patent
Olivetti et al.

(10) Patent No.: US 7,059,283 B2
(45) Date of Patent: Jun. 13, 2006

(54) SYSTEM AND METHOD OF RETAINING HYDRAULIC FLUID IN A HYDRAULIC VALVE ACTUATION SYSTEM

(76) Inventors: Gian M. Olivetti, Corso Re Umberto 30, Torino (IT) 10128; Harald Fessler, Thurgauerstr. 23, Arbon (CH) 9320; Richard E. Vanderpoel, 1 Musket Trail, Bloomfield, CT (US) 06002

( * ) Notice: Subject to any disclaimer, the term of this patent is extended or adjusted under 35 U.S.C. 154(b) by 0 days.

(21) Appl. No.: 10/737,932

(22) Filed: Dec. 18, 2003

(65) Prior Publication Data

US 2005/0132985 A1 Jun. 23, 2005

(51) Int. Cl.
*F01L 9/02* (2006.01)

(52) U.S. Cl. ..... 123/90.12; 60/591; 60/413; 251/62; 251/63

(58) Field of Classification Search ..... 123/92.12; 60/584, 592, 453, 591, 413; 251/62, 63, 251/63.4, 63.5, 63.6
See application file for complete search history.

(56) References Cited

U.S. PATENT DOCUMENTS 3,938,770 A * 2/1976 Turner et al. ..... 248/550
4,278,233 A 7/1981 Zurner et al. ..... 251/57
5,410,994 A * 5/1995 Schechter ..... 123/90.12
6,257,183 B1 * 7/2001 Vorih et al. ..... 123/90.12
6,510,824 B1 * 1/2003 Vorih et al. ..... 123/90.12
6,758,175 B1 * 7/2004 Dinkel et al. ..... 123/90.12

* cited by examiner

*Primary Examiner*—Thomas Denion
*Assistant Examiner*—Zelalem Eshete
(74) *Attorney, Agent, or Firm*—David R. Yohannan, esq.; Kelley Drye & Warren LLP

(57) ABSTRACT

Methods and systems for retaining hydraulic fluid in a hydraulic valve actuation system adapted to be installed on an internal combustion engine are disclosed. The system may include a hydraulic fluid supply connected by one or more passages to a fluid accumulator and a hydraulic valve actuator. The one or more passages may include a retaining portion elevated above portions of the fluid accumulator and/or the hydraulic valve actuator. The retaining portion may include an air vent and thus prevent back flow of all the fluid in the accumulator and/or hydraulic valve actuator to the fluid supply during periods that the engine is shut off. Retention of hydraulic fluid in the system may be further enhanced during engine shut off by selectively controlling the release of hydraulic fluid from the hydraulic valve actuator during the engine shut off process.

19 Claims, 3 Drawing Sheets

SYSTEM AND METHOD OF RETAINING HYDRAULIC FLUID IN A HYDRAULIC VALVE ACTUATION SYSTEM

FIELD OF THE INVENTION

The present invention generally relates to systems and methods for retaining hydraulic fluid in a hydraulic valve actuation system.

BACKGROUND

Valve actuation in an internal combustion engine is required in order for the engine to produce positive power and may also be used to provide engine braking. Typically, engine valves may be actuated in response to the rotation of cams. One or more lobes on the cam may displace the engine valve directly, or act on one or more valve train elements, such as a push tube or rocker arm, connecting the cam to the engine valve. During positive power, intake valves may be opened to admit fuel and air into a cylinder for combustion and/or exhaust gas recirculation (EGR). The exhaust valves may be opened to allow combustion gas to escape from the cylinder and/or for EGR.

During engine braking, the exhaust valves may be selectively opened to convert, at least temporarily, an internal combustion engine of compression-ignition type into an air compressor. This air compressor effect may be accomplished by cracking open one or more exhaust valves near piston top dead center position for compression-release type braking, or by maintaining one or more exhaust valves in a cracked open position for much or all of the piston motion for bleeder-type braking. In doing so, the engine develops retarding horsepower to help slow the vehicle down. This can provide the operator increased control over the vehicle and substantially reduce wear on the service brakes of the vehicle. A properly designed and adjusted engine brake can develop retarding horsepower that is a substantial portion of the operating horsepower developed by the engine in positive power.

For both positive power and engine braking applications, the timing of the opening and closing of the engine cylinder intake, exhaust, and auxiliary valves is determined by the shape or profile of cams with one or more fixed lobes. Fixed lobes on the cams may make it difficult to adjust the timings and/or amounts of engine valve lift needed to optimize valve openings and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic or other linkage means. Many lost motion systems use a hydraulic link to provide varying levels of valve actuation. Some hydraulic valve actuation systems that are adapted to selectively vary the amount of lost motion during engine operation are referred to as Variable Valve Actuation (VVA) systems.

An example of a variable valve actuation lost motion system is described fully in U.S. Pat. No. 6,510,824 to Vorih, et a., (Jan. 23, 2003), which is hereby incorporated by reference. Other examples of such systems are provided in Vorih, et al., U.S. Pat. No. 5,829,397 (Nov. 3, 1998), Hu, U.S. Pat. No. 6,125,828 (Oct. 3, 2000), and Hu, U.S. Pat. No. 5,680,841 (Oct. 28, 1997), and which are incorporated herein by reference.

An engine must have some level of valve actuation to start and continue to run. Without valve actuation, fresh air cannot be introduced into, and exhaust gas cannot be removed from, the cylinders. Engines that incorporate hydraulic valve actuation systems may require an immediate and sustained supply of hydraulic fluid to operate the engine valves. Therefore, it is desirable to have a sufficient supply of hydraulic fluid available for the valve actuation systems at the time of starting an engine.

It is therefore an advantage of some, but not necessarily all, embodiments of the present invention to provide hydraulic fluid to a hydraulic valve actuation system at engine start-up. It is also an advantage of some, but not necessarily all, embodiments of the present invention to retain some amount of hydraulic fluid in a hydraulic valve actuation system after engine shut-off.

Additional advantages of various embodiments of the invention are set forth, in part, in the description that follows, and in part, will be apparent to one of ordinary skill in the art from the description and/or from the practice of the invention.

SUMMARY

Responsive to the foregoing challenges, Applicants have developed an innovative hydraulic valve actuation system adapted to be installed on an internal combustion engine, comprising: a plurality of hydraulic passages connecting a piston bore, an accumulator, and a trigger valve to a hydraulic fluid supply; a retaining passage connecting the fluid supply to the hydraulic passages, the retaining passage having at least one portion elevated above at least one portion of the hydraulic passages; an air vent connected to said retaining passage; and means for selectively opening and closing the trigger valve during engine shut-off to maintain some hydraulic fluid in the hydraulic valve actuation system.

Applicants have further developed an innovative hydraulic valve actuation system adapted to be installed on an internal combustion engine, comprising: a plurality of hydraulic passages connecting a piston bore, an accumulator, and a trigger valve to a hydraulic fluid supply; a retaining passage connecting the fluid supply to the hydraulic passages, the retaining passage having at least one portion elevated above at least one of the hydraulic passages; and an air vent connected to the retaining passage.

Applicants have yet further developed an innovative hydraulic valve actuation system adapted to be installed on an internal combustion engine, comprising: a hydraulic fluid supply; a fluid accumulator; a passage connecting the fluid supply with the accumulator, the passage having at least one portion elevated above a point at which the passage connects to the accumulator; and an air vent connected to the passage.

Applicants have still further developed an innovative hydraulic valve actuation system of an internal combustion machine, comprising: a hydraulic fluid supply; an accumulator; and a passage connecting the fluid supply with the accumulator, the passage including a non-valve means for retarding the drainage of hydraulic fluid from the accumulator towards the hydraulic fluid supply.

Applicants have also developed an innovative hydraulic valve actuation system adapted to be installed on an internal combustion engine, comprising: a plurality of hydraulic passages connecting a piston bore, an accumulator, and a trigger valve to a hydraulic fluid supply; means for selectively opening and closing the trigger valve during engine shut-off to maintain some hydraulic fluid in the hydraulic valve actuation system.

Applicants have further developed an innovative method of retaining hydraulic fluid in a hydraulic valve actuation system used to actuate an engine valve, comprising the steps of: providing hydraulic fluid to the hydraulic valve actuation system through a trigger valve during engine operation; initiating engine shut-off; and maintaining the trigger valve closed during a substantial portion of a main valve event responsive to initiation of engine shut-off.

Applicants have still further developed an innovative method of maintaining hydraulic fluid in a hydraulic valve actuation system operatively connected to a cam having one or more lobes, the method comprising the steps of: providing hydraulic fluid to the hydraulic valve actuation system through a trigger valve during engine operation; initiating engine shut-off; and closing the trigger valve during one or more periods corresponding to one or more cam lobes responsive to initiation of engine shut-off.

It is to be understood that both the foregoing general description and the following detailed description are exemplary and explanatory only, and are not restrictive of the invention as claimed.

BRIEF DESCRIPTION OF THE DRAWINGS

In order to assist in the understanding of this invention, reference will now be made to the appended drawings, in which like reference characters refer to like or similar elements.

DETAILED DESCRIPTION OF EMBODIMENTS OF THE INVENTION

Figure 1:
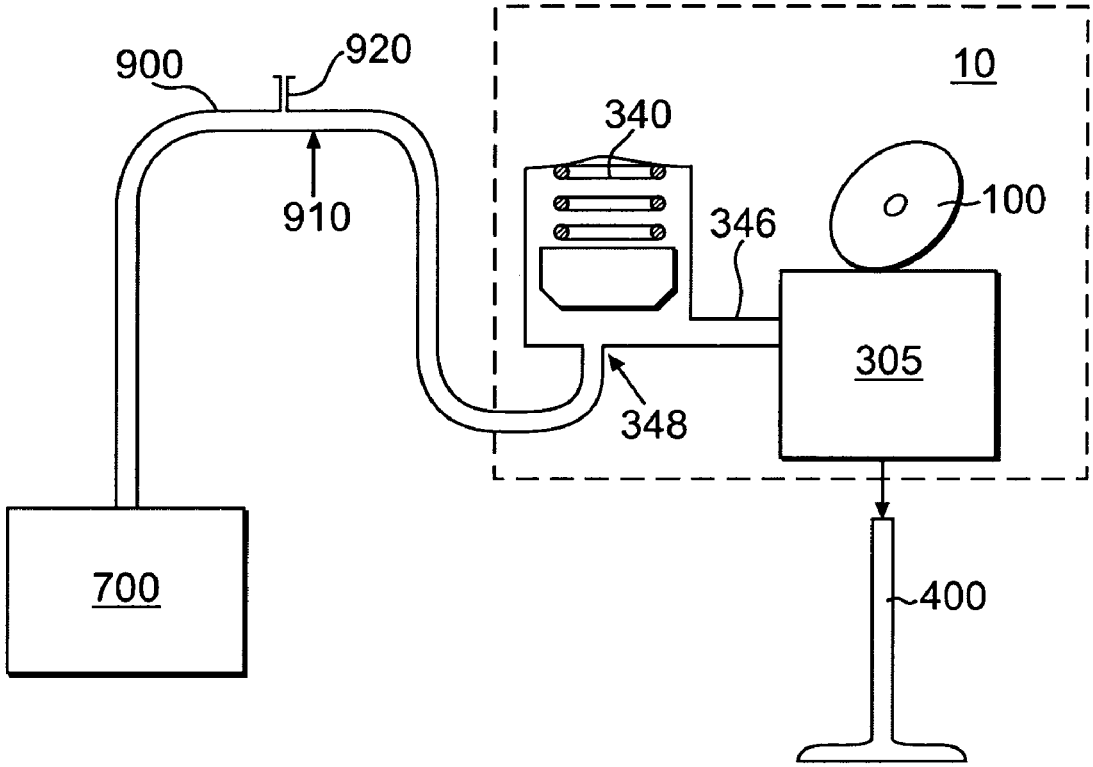
FIG. 1 is a schematic diagram of a hydraulic valve actuation system in accordance with an embodiment of the present invention.

Reference will now be made in detail to a first embodiment of the present invention, which is shown in FIG. 1. With reference to FIG. 1, an engine valve 400 is operatively connected to a hydraulic valve actuation system 10, which includes a means for imparting motion 100, such as a cam, a hydraulic actuator 305 and a hydraulic accumulator 340. Hydraulic fluid may be provided to the hydraulic valve actuation system 10 by a low pressure hydraulic supply 700 via a hydraulic fluid retaining passage 900. The retaining passage 900 may include at least one portion 910 elevated above the third passage 348 at the point it connects to the accumulator 340 and/or elevated above at least a portion of a second passage 346 that connects the accumulator to the hydraulic actuator 305. The retaining passage 900 may also include an air vent 920 located at a point along the inverted U-shaped portion 910 of the retaining passage 900.

During engine operation, hydraulic fluid may be supplied to the hydraulic valve actuation system 10 from the low pressure supply 700. Hydraulic fluid in the low pressure supply 700 flows through the retaining passage 900 to the valve actuation system 10. A small amount of hydraulic fluid may leak out of the retaining passage 900 through the air vent 920. The air vent 920 should be sized so that it does not frustrate the delivery of hydraulic fluid to the valve actuation system 10. Fluid from the retaining passage 900 may displace the accumulator piston 341 to some extent and fill the second passage 346 and the hydraulic actuator 305. The hydraulic actuator 305 may be controlled to selectively maintain and release the hydraulic fluid provided to it.

Hydraulic fluid may be selectively released from and added to the hydraulic valve actuator 305 to provide a desired level of valve actuation for the engine valve 400. Once the hydraulic valve actuation system 10 is charged with hydraulic fluid and the hydraulic actuator 305 is instructed to maintain hydraulic fluid, the cam 100 imparts the greatest level of motion to the hydraulic valve actuator and the engine valve 400. When the hydraulic valve actuator is selectively instructed to release fluid, the downward force applied to it from the cam 100 may drive hydraulic fluid out of the hydraulic valve actuator 305 and into the accumulator 340. The more fluid released from the hydraulic valve actuator 305, the less motion imparted from the cam 100 to the engine valve 400. The fluid in the accumulator 340 may be used to refill the hydraulic valve actuator 305 in addition to the fluid that is available from the low pressure supply 700.

Figure 2:
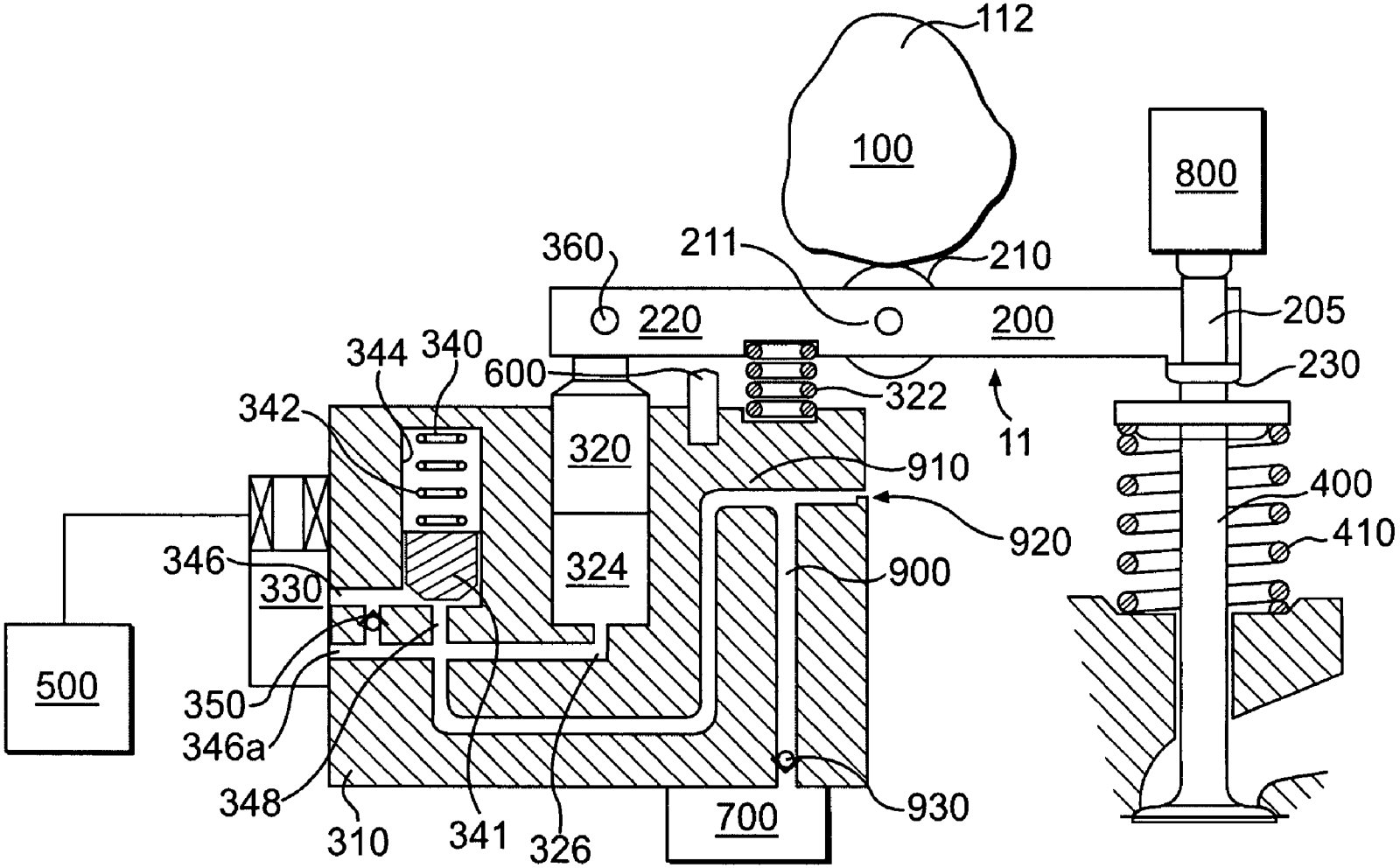
FIG. 2 is cross-section of a hydraulic valve actuation system in accordance with a second embodiment of the present invention.

A second embodiment of the present invention is illustrated by FIG. 2. With reference to FIG. 2, a hydraulic valve actuation system, which in this embodiment is a variable valve actuation (VVA) system 11, disposed between a cam 100 and an engine valve 400. The cam 100 may include one or more cam lobes 112, etc., for imparting one or more corresponding engine valve actuation motions or events to the VVA system 11. The VVA system 11 is shown to act on a single engine valve 400, however, it is appreciated that the VVA system 11 may act on more than one engine valve through a valve bridge in alternative embodiments.

Each VVA system 11 may also include a housing 310, a piston 320, an accumulator 340, and a trigger valve 330. The housing 310 may include multiple passages therein for the transfer of hydraulic fluid through the system. A first passage 326 in the housing 310 may connect a bore 324 for the piston 320 with the trigger valve 330. A second passage 346 may connect the trigger valve 330 with the accumulator 340. A third passage 348 may connect the accumulator 340 with the retaining passage 900, which in turn is connected to the hydraulic fluid supply 700. A check valve 350 may be disposed in a fourth passage extending between the first passage 326 and the second passage 346. In an alternative embodiment, the check valve 350, and the fourth passage within which it is disposed, may not be required.

The accumulator 340 may assist in maintaining low pressure fluid in the first, second, third and fourth hydraulic passages so that they may be drained and refilled rapidly. The accumulator 340 may include an accumulator piston 341 slidably disposed in an accumulator bore 344 and biased downward by an accumulator spring 342. Hydraulic fluid that passes back from the piston bore 324 may be stored in the accumulator 340 until it is used to refill the piston bore 324.

The high speed trigger valve 330 may assist in controlling the amount of hydraulic fluid in the piston bore 324. The high-speed trigger valve 330 may be capable of being opened and closed as many as one or more times per engine cycle to enable locking and unlocking the piston 320. An electronic valve controller 500 may be used to control the position of the movable portion of the trigger valve 330. Unblocking the passage through the trigger valve 330 enables hydraulic fluid in the bore 324 and the first passage 326 to be transferred to the accumulator 340.

During engine operation, hydraulic fluid may be supplied to the VVA system 11 from the low pressure supply 700. Hydraulic fluid in the low pressure supply 700 flows past a second (optional) check valve 920 through retaining passage 900 and into the third passage 348. Fluid from the third passage 348 may displace the accumulator piston 341 to some extent and fill the second and first passages 346 and 326, flowing through the check valve 350. Selective opening of the trigger valve 330 may also be used to allow hydraulic fluid to flow from the second passage 346 to the first passage 326. In this manner, hydraulic fluid is supplied to the piston bore 324 for upward displacement of the piston 320. The piston 320 may attain its most upward position when the cam 100 is at base circle. The base circle portions of the cam 100 include all portions other than those occupied by the one or more lobes 112 on the cam.

Once the system 11 is charged with hydraulic fluid and the piston 320 has attained its most upward position, the trigger valve 330 may be closed so that the hydraulic fluid in the bore 324 maintains the piston 320 in its position. When the trigger valve is maintained closed with the piston 320 in its most upward position, the cam lobes 112 impart the greatest level of motion to the pivoting bridge 200 and engine valve 400. When the trigger valve 330 is selectively opened, the downward force applied to the piston 320 from the cam lobe(s) 112 may drive hydraulic fluid out of the piston bore 324 through the first passage 326, the trigger valve 330, and the second passage 346 into the accumulator 340. The more fluid released from the piston bore 324, the less motion imparted from the cam lobes 112 to the pivoting bridge 200 and the engine valve 400.

The trigger valve 330 may be opened and closed under the direction of the controller 500. The controller 500 may determine a desired level of valve actuation for the engine valve 400 and determine the require position of the piston 320 to achieve this level of valve actuation. The controller 500 may then selectively open and close the trigger valve 330 to provide the required position of the piston 320 throughout the engine cycle.

When the trigger valve 330 is opened and the piston 320 is forced downward under the influence of the cam lobe(s) 112, displaced hydraulic fluid may accumulate in the accumulator 340. The fluid in the accumulator 340 may be used to refill the piston bore 324 rapidly when the cam 100 is back at base circle and the trigger valve 330 is open. Thus, the accumulator 340 serves as a depository for hydraulic fluid that is local to the piston bore 324.

The hydraulic valve actuation systems 10 and 11, such as those shown in FIGS. 1 and 2, for example, require hydraulic fluid in order to operate properly. Because valve actuation is needed immediately for engine starting, there is a need for hydraulic fluid retention in, and/or rapid supply to, the valve actuation system at the time of engine starting. However, the hydraulic fluid contained in these systems may drain out over time and/or need to travel a substantial distance from the low pressure supply 700 after the engine is shut-off.

With reference to the system shown in FIG. 2, for example, when the engine is shut-off hydraulic fluid in the system may drain from the piston bore 324 and the accumulator bore 344 towards the hydraulic supply 700. Hydraulic fluid may also leak pass the check valve 350. The recharging of the system with hydraulic fluid upon initial start of the engine may take some time, during which there will be no "hydraulically activated" valve motion. In instances of prolonged shut-off, a substantial amount of hydraulic fluid may be drained from the engine frustrating and preventing start-up, or causing engine damage.

Hydraulic fluid may be retained in the hydraulic valve actuation systems 10 and 11 (FIGS. 1 and 2) for some period of time following engine shut-off by inclusion of the retaining passage 900 and/or selective control of the opening and closing of the trigger valve 330. With reference to FIGS. 1 and 2, the retaining passage 900 may connect the low pressure hydraulic fluid supply 700 with the third passage 348. The retaining passage 900 may have at least one portion elevated above one or more of the first, second, or third passages 326, 346, or 348. The retaining passage 900 may also have at least one portion elevated above a portion of the accumulator 340, particularly the lower portion of the accumulator or the point at which the third passage 348 connects to the accumulator. Additionally, the retaining passage 900 may have at least one bend 910 with an air vent 920 positioned substantially above a portion of the passages 326, 346, and 348, and/or the accumulator 340. The retaining passage 900 may be shaped so that when fluid drains back from the accumulator 340 and/or the piston 320 during engine shut-off, air enters the retaining passage 900 through the air vent 920 and breaks the siphon action drawing the fluid back to the low pressure supply 700. The retaining passage 900 has an inverted u-shape that assists in containing hydraulic fluid in the hydraulic valve actuation system. The position and shape of the retaining passage 900 compared to the passages 326, 346, and 348, the accumulator 340, and the piston 320 may retard the drainage of hydraulic fluid. The configuration of the retaining passage 900 may vary depending upon the housing 310, the engine, the bore 324, and/or the accumulator 340 without departing from the intended scope of the invention.

In other embodiments of the present invention, the retaining passage 900 may also include an optional check valve 930. The check valve 930 may also control the flow of hydraulic fluid out of and into the hydraulic fluid supply 700.

Figure 3:
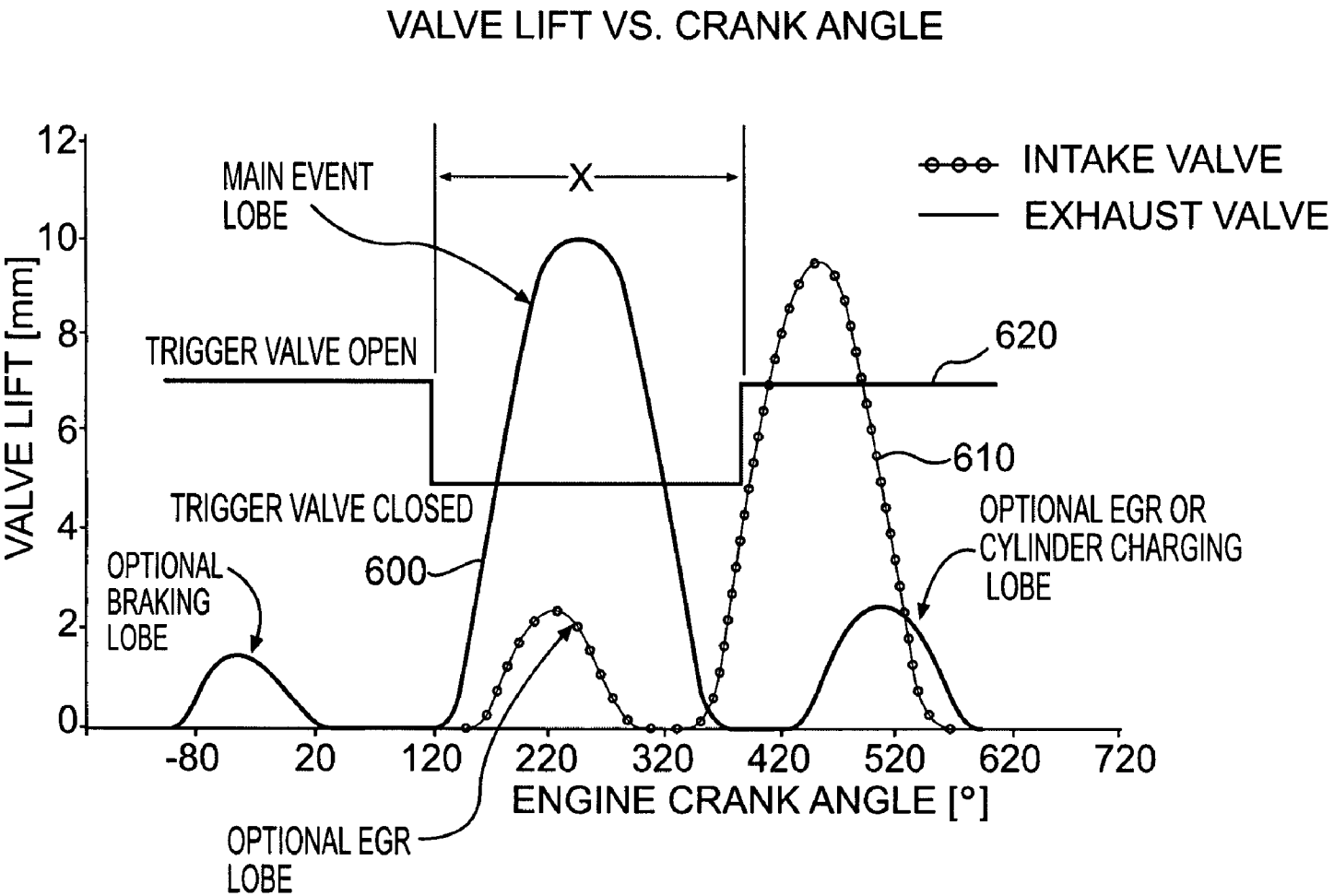
FIG. 3 is a graph of crank angle position versus valve lift and trigger valve position which illustrates an example of trigger valve timing that may be employed in a method embodiment of the present invention.

Hydraulic fluid may be further retained in the hydraulic valve actuation system by selectively controlling the flow of hydraulic fluid into and out of the hydraulic valve actuator 305 shown in FIG. 1, or through the selective opening and closing of the trigger valve 330 shown in FIG. 2, during engine shut-off. Before engine shut-off, normal operation of the hydraulic valve actuation systems 10 and 11 causes hydraulic fluid to fill the hydraulic actuator 305 (FIG. 1) or the piston bore 324 (FIG. 2) from the low pressure hydraulic supply 700. If the connection between the low pressure supply 700 and the hydraulic actuator 305 (FIG. 1) or the trigger valve 330 (FIG. 2) is maintained in an open position as the cam 100 rotates, the lobes 112 on the cam will increase pressure in the hydraulic actuator 305 or the piston bore 324 and force the hydraulic fluid out of the hydraulic actuator or piston bore. The loss of hydraulic fluid from the hydraulic actuator or the piston bore can be reduced, however, by selectively controlling the timing of the release of hydraulic fluid from each of these devices. In the system shown in FIG. 2, release of hydraulic fluid is achieved through control of the trigger valve 330. An example embodiment of the trigger valve 330 timing that may assist in maintaining hydraulic fluid in a hydraulic valve actuation system is illustrated in FIG. 3. FIG. 3 shows both the exhaust valve cam profile 600 and the intake valve cam profile 610, which each include main event and auxiliary events (e.g., braking and EGR). It is appreciated that the invention may be used with different cam profiles that include more or fewer events than shown in FIG. 3.

The trigger valve timing that enables hydraulic fluid to be maintained in the exhaust valve hydraulic actuation system is illustrated in FIG. 3. The exhaust valve timing is illustrated as line 600 and the trigger valve timing is illustrated as line 620. The trigger valve timing is synchronized with that of the exhaust valve so that the trigger valve remains open through the entire exhaust cam profile except during the main event, i.e., the main exhaust event. During the main exhaust event on engine shut-off, the trigger valve is closed trapping hydraulic fluid in the bore 324, shown as period x in the graph of FIG. 3. As a result, the main exhaust lobe cannot force hydraulic fluid out of the piston bore.

As will be apparent to those of ordinary skill in the art, the timing of the release of hydraulic fluid from the piston bore or hydraulic actuator during engine shut-off may vary depending upon the base circle locations of the cam profile and the fluid flow characteristics of the hydraulic actuator 305 or the piston bore 324. The release of hydraulic fluid from the hydraulic valve actuation system may be prevented during any part of any one or more of the valve events produced by the engine cam without departing from the intended scope of the present invention. Furthermore, it should be appreciated that the selective release of hydraulic fluid from the piston bore or the hydraulic actuator may be carried out in connection with hydraulic valve actuation systems used for exhaust, intake, and/or auxiliary engine valves without departing from the intended scope of the present invention. The foregoing description of exemplary embodiments of the present invention are not intended to be limiting, but illustrative only, and changes may be made in detail, especially in matters of shape, size and arrangement of parts, without departing from the intended scope of the invention.

The invention claimed is:

1. A hydraulic valve actuation system adapted to be installed on an internal combustion engine, comprising:

a plurality of hydraulic passages connecting a piston bore, an accumulator, and a trigger valve;

a retaining passage connecting a hydraulic fluid supply to the hydraulic passages, the retaining passage having at least one portion elevated above at least one portion of the hydraulic passages;

an air vent provided along said retaining passage; and means for selectively opening and closing the trigger valve during engine shut-off to maintain some hydraulic fluid in the hydraulic valve actuation system.

2. The system of claim 1, wherein the retaining passage further comprises at least one u-shaped bend.

3. The system of claim 1, further comprising a check valve disposed within the retaining passage.

4. The system of claim 1, wherein the means for selectively opening and closing is adapted to close the trigger valve during at least a substantial portion of a main valve event.

5. A hydraulic valve actuation system adapted to be installed on an internal combustion engine, comprising:

a plurality of hydraulic passages connecting a piston bore, an accumulator, and a trigger valve to a hydraulic fluid supply;

a retaining passage connecting the hydraulic fluid supply to the hydraulic passages, the retaining passage having at least one portion elevated above at least one portion of the hydraulic passages; and means for air to enter the retaining passage.

6. The system of claim 5, wherein the retaining passage is elevated above a lower portion of the accumulator.

7. The system of claim 5, wherein the retaining passage is elevated above a lower portion of the piston bore.

8. The system of claim 5, wherein the retaining passage further comprises at least one u-shaped bend.

9. The system of claim 5, further comprising a check valve disposed within the retaining passage.

10. A hydraulic valve actuation system adapted to be installed on an internal combustion engine, comprising:

a hydraulic fluid supply;

a fluid accumulator;

a passage connecting the fluid supply with the accumulator, the passage having at least one portion elevated above a point at which the passage connects to the accumulator; and means for air to enter the passage at a point between the fluid supply and the accumulator.

11. The system of claim 10, wherein the passage further comprises at least one u-shaped bend.

12. The system of claim 10, further comprising a check valve disposed in the passage between the fluid supply and the fluid accumulator.

13. A hydraulic valve actuation system of an internal combustion engine, comprising:

a hydraulic fluid supply;

an accumulator; and a passage connecting the fluid supply with the accumulator, the passage including a non-valve means for retarding the drainage of hydraulic fluid from the accumulator towards the hydraulic fluid supply.

14. A hydraulic valve actuation system adapted to be installed on an internal combustion engine, comprising:

a plurality of hydraulic passages connecting a piston bore, an accumulator, and a trigger valve to a hydraulic fluid supply; and means for selectively opening and closing the trigger valve during engine shut-off to maintain some hydraulic fluid in the hydraulic valve actuation system.

15. The system of claim 14, wherein the means for selectively opening and closing is adapted to close the trigger valve during at least a substantial portion of a main valve event.

16. The system of claim 14, further comprising a check valve disposed within the hydraulic passages.

17. A method of retaining hydraulic fluid in a hydraulic valve actuation system used to actuate an engine valve, comprising the steps of:

providing hydraulic fluid to the hydraulic valve actuation system through a trigger valve during engine operation;

initiating engine shut-off; and maintaining the trigger valve closed during a substantial portion of a main valve event responsive to initiation of engine shut-off, wherein the hydraulic valve actuation system is operatively connected to a cam having at least a main event lobe and a base circle portion, said method further comprising the step of maintaining the trigger valve open during at least a substantial portion of the base circle cam portion.

18. A method of maintaining hydraulic fluid in a hydraulic valve actuation system operatively connected to a cam having one or more lobes, the method comprising the steps of:

providing hydraulic fluid to the hydraulic valve actuation system through a trigger valve during engine operation;

initiating engine shut-off; and closing the trigger valve during one or more periods corresponding to one or more cam lobes responsive to initiation of engine shut-off, wherein the trigger valve is closed during an exhaust gas recirculation event cam lobe.

19. A method of maintaining hydraulic fluid in a hydraulic valve actuation system operatively connected to a cam having one or more lobes, the method comprising the steps of:

providing hydraulic fluid to the hydraulic valve actuation system through a trigger valve during engine operation;

initiating engine shut-off; and closing the trigger valve during one or more periods corresponding to one or more cam lobes responsive to initiation of engine shut-off, wherein the trigger valve is closed during a braking event cam lobe.

* * * * *